US009774090B2

(12) United States Patent
Park

(10) Patent No.: US 9,774,090 B2
(45) Date of Patent: Sep. 26, 2017

(54) ULTRA-WIDE BAND ANTENNA

(71) Applicant: LG Innotek Co., Ltd., Seoul (KR)

(72) Inventor: Young Hun Park, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 14/906,077

(22) PCT Filed: Jul. 16, 2014

(86) PCT No.: PCT/KR2014/006445

§ 371 (c)(1),
(2) Date: Jan. 19, 2016

(87) PCT Pub. No.: WO2015/009058

PCT Pub. Date: Jan. 22, 2015

(65) Prior Publication Data

US 2016/0164185 A1 Jun. 9, 2016

(30) Foreign Application Priority Data

Jul. 16, 2013 (KR) ..... 10-2013-0083596

(51) Int. Cl.
*H01Q 1/24* (2006.01)
*H01Q 13/10* (2006.01)
(Continued)

(52) U.S. Cl.
CPC ..... *H01Q 13/106* (2013.01); *H01Q 1/24* (2013.01); *H01Q 1/46* (2013.01); *H01Q 7/00* (2013.01); *H01Q 9/0407* (2013.01)

(58) Field of Classification Search
CPC ..... H01Q 13/106; H01Q 1/24; H01Q 1/46; H01Q 7/00; H01Q 9/0407
(Continued)

(56) References Cited

U.S. PATENT DOCUMENTS

2009/0184880 A1* 7/2009 Marklein ..... H01Q 7/00 343/866

FOREIGN PATENT DOCUMENTS

JP 2009124285 A 6/2009
KR 1020050053077 A 6/2005
(Continued)

OTHER PUBLICATIONS

International Search Report in International Application No. PCT/KR2014/006445, filed Jul. 16, 2014.

*Primary Examiner* — Dameon E Levi
*Assistant Examiner* — Andrea Lindgren Baltzell
(74) *Attorney, Agent, or Firm* — Saliwanchik, Lloyd & Eisenschenk

(57) ABSTRACT

Disclosed is an ultra-wide band antenna. An antenna according to the present invention comprises: a radiating body for emitting electromagnetic waves passing through the antenna; a feeder unit for supplying electric signals to the radiating body; and an impedance feeder unit, having a rectangular shape, connecting the radiating body and the feeder unit, and the antenna additionally comprises a slotted part in the interior of the radiating body to increase the effectiveness of the antenna. Additionally, the diameter of the radiating body is 2.0~3.0 times the length, in the horizontal-direction, of the impedance feeder unit, and the length, in the vertical-direction, of the impedance feeder unit is 1.0~1.3 times the length thereof in the horizontal direction, and as such, the present invention can be applied to a device utilizing multiple-input and multiple-output and high-speed data, the device having secured an ultra-wide band by means of a single antenna.

5 Claims, 7 Drawing Sheets

(51) Int. Cl.
*H01Q 1/46* (2006.01)
*H01Q 7/00* (2006.01)
*H01Q 9/04* (2006.01)

(58) Field of Classification Search
USPC ..... 343/767
See application file for complete search history.

(56) References Cited

FOREIGN PATENT DOCUMENTS

| | | | |
|---|---|---|---|
| KR | 1020060028953 | A | 4/2006 |
| KR | 1020090039910 | A | 4/2009 |
| KR | 1020120129295 | A | 11/2012 |

* cited by examiner

ULTRA-WIDE BAND ANTENNA

This application is a U.S. National Stage application of international application PCT/KR2014/006445, filed in Korea on Jul. 16, 2014, which designates the United States, and which claims the benefit of the Korean Patent Application Number 10-2013-0083596, filed on Jul. 16, 2013, the disclosure of which is incorporated by reference herein in its entirety.

TECHNICAL FIELD

The present invention relates to an ultra wide band antenna.

BACKGROUND ART

An ultra wide band communication is a next generation wireless communication technology and called an UWB (Ultra Wideband) or a wireless digital pulse. One of the greatest distinct features of the UWB communication is that it can use GHz band frequency and can also output several thousands to several million times of low output pulses per second. The UWB communication can transmit massive data up to 70 m with a low power of 0.5 m/W, and can transmit the massive data to underground or to rear side of a wall as well. The UWB communication has a wide range of applications in that it enables a super high speed internet access and can monitor a particular area using a radar function, and can assist in rescue operation when disaster occurs using radio detection and location function.

Furthermore, the UWB communication is faster by 10~20 times over the conventional wireless communication technologies of IEEE 802.11 and Bluetooth, but required power is less than 1/100 level over mobile phone or wireless LAN, and particularly, can be used for PAN (Personal Area Network) that connects, via super speed wireless interface, a personal computer to a peripheral and a home electronic appliance positioned within at around 10 m in an office or a house. A conventional antenna having the UWB characteristics uses a variety of radiator structures according to service purposes. In this case, various types of antennas are embedded in one system to generate performance degradation caused by antenna interferences and internal noise caused by mutual coupling of electronic systems inside a system.

One of widely used methods to minimize the interferences, an antenna area arranged inside a system is separately designated whereby the antenna interferences can be minimized. Particularly, an antenna must maintain a predetermined space from a surrounding radiator to exhibit a performance as an antenna, and therefore, various methods to improve the performance is being sought after and studied.

DETAILED DESCRIPTION OF THE INVENTION

Technical Subject

It is an object of the present invention to provide an ultra wide band antenna configured to reduce a performance deterioration caused by antenna interferences.

Technical Solution

In one general aspect of the present invention, there is provided an ultra wide band antenna, the ultra wide band antenna comprising:

a radiator configured to emit electromagnetic wave passing through the antenna;

a feeder configured to supply an electric signal to the radiator; and an impedance feeder connected to the radiator to the feeder and having a square structure.

Preferably, but not necessarily, the ultra wide band antenna may further comprise a slot portion inside the radiator configured to increase antenna efficiency.

Preferably, but not necessarily, a diameter of the radiator may be longer by 2.0~3.0 times than a cross-wise length of the impedance feeder.

Preferably, but not necessarily, a vertical direction length of the impedance feeder may be longer by 1.0~1.3 times than cross direction length of the impedance feeder.

Preferably, but not necessarily, the ultra wide band antenna may further comprise a metal reflective patch coupled to an upper surface of the radiator, and equal to or smaller in size than the radiator.

Preferably, but not necessarily, the radiator may take a round shape.

Preferably, but not necessarily, the radiator may take a triangular shape or a shape having more apexes than a triangle.

Advantageous Effects

The ultra wide band antenna according to the exemplary embodiments of the present invention has an advantageous effect in that the antenna can be applied to a device using an MIMO (Multiple Input Multiple Output) communication of an ultra wide band and a high speed data communication.

Another advantageous effect is that the antenna is less affected by frequency change caused by metal and dielectric substance due to using ultra wide band.

Still another advantageous effect is that a metal is arranged at a side opposite to the antenna for application as a patch antenna whereby antenna efficiency can be increased.

DETAILED DESCRIPTION OF THE INVENTION

Various exemplary embodiments will be described more fully hereinafter with reference to the accompanying drawings, in which some exemplary embodiments are shown. The present inventive concept may, however, be embodied in many different forms and should not be construed as limited to the example embodiments set forth herein. Rather, the described aspect is intended to embrace all such alterations, modifications, and variations that fall within the scope and novel idea of the present disclosure.

Hereinafter, exemplary embodiments of the present invention will be described in detail with reference to the accompanying drawings.

Figure 1:
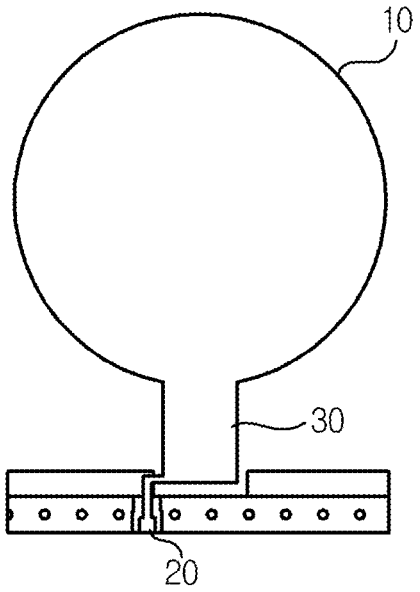
FIGS. 1 and 2 are schematic views illustrating configuration of an ultra wide band antenna according to an exemplary embodiment of the present invention.
Figure 2:
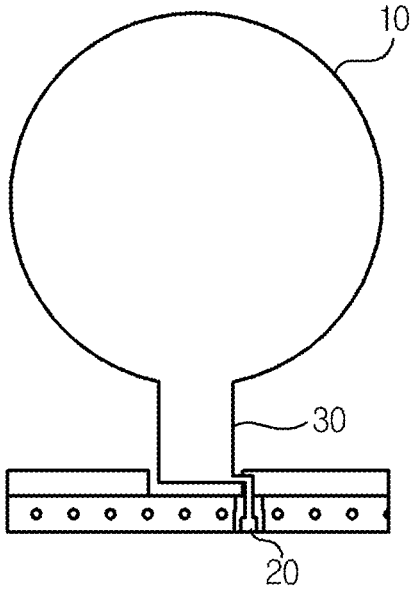

FIGS. 1 and 2 are schematic views illustrating configuration of an ultra wide band antenna according to an exemplary embodiment of the present invention.

The ultra wide band antenna according to an exemplary embodiment of the present invention may include a radiator (10), a feeder (20) and an impedance feeder (30).

The radiator (10) is an element in an antenna communication configured to directly emit an electromagnetic wave to a space toward a reflector for collimation or direction setting purpose. The radiator (10) used in an ultra wide band antenna according to an exemplary embodiment of the present invention may take a round shape, and may have a broader ultra wide band characteristic to a low frequency band when a diameter is increased.

FIGS. 1 and 2 illustrate a configuration of an ultra wide band antenna according to an exemplary embodiment of the present invention, and more particularly illustrate a configuration of a position of a feeder.

The feeder (20) may be positioned at a left side of the radiator as illustrated in FIG. 1, and may be positioned at a right side as illustrated in FIG. 2. Furthermore, albeit not shown in the drawings, the feeder (20) may be positioned at a center. The feeder may be variably positioned according to a user option.

The position of the feeder is to change a phase of a signal, and when two antennas are used, the feeder may be positioned at a right side and a left side to allow a phase between two signals to be at 180 degree, and when three antennas are used, the feeder may be positioned at left/right and a center to allow a phase of the three signals to be at 120 degrees. Furthermore, when four antennas are used, the feeder may be positioned at left/right and ½ positions of the feeders positioned at left/right based on the center to allow a phase of four signals to be at 90 degrees.

The feeder (20) serves to supply an electric signal to the radiator, and is a place where a current induced by an electric wave received by the radiator is transmitted. The electric signal transmitted from the feeder (20) to the radiator may be emitted from an electric energy to a wireless energy through the radiator (10).

The impedance feeder (30) of square shape serves to link the radiator (10) and the feeder (20). The impedance feeder (30) may transmit an electric signal supplied from the feeder (20) to the radiator (10) by effectively distributing the electric signal.

Figure 3:
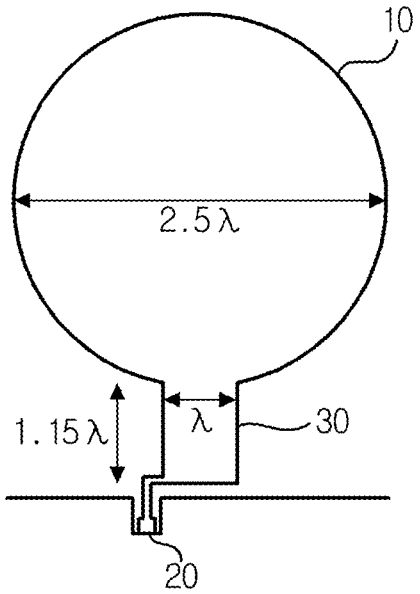
FIG. 3 is a schematic view illustrating size of an ultra wide band antenna according to an exemplary embodiment of the present invention.
Figure 4A:
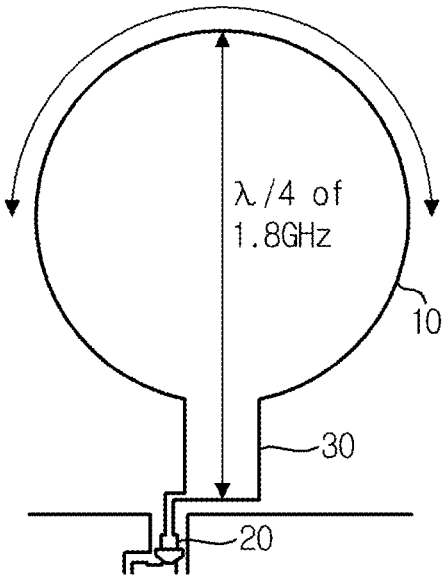
FIG. 4 is a schematic view illustrating a wavelength useable by an ultra wide band antenna according to an exemplary embodiment of the present invention.
Figure 4B:
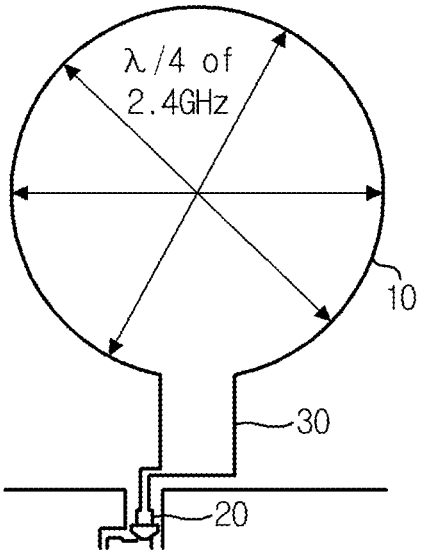
Figure 4C:
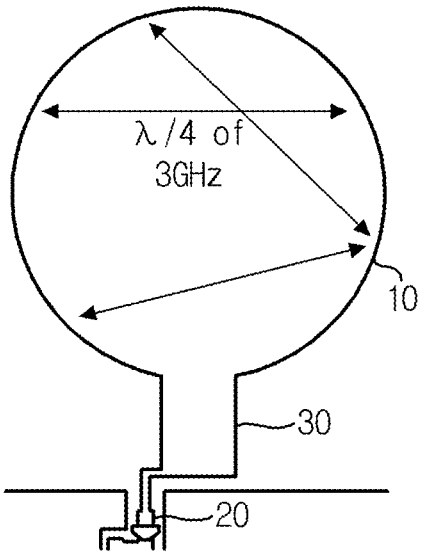
Figure 4D:
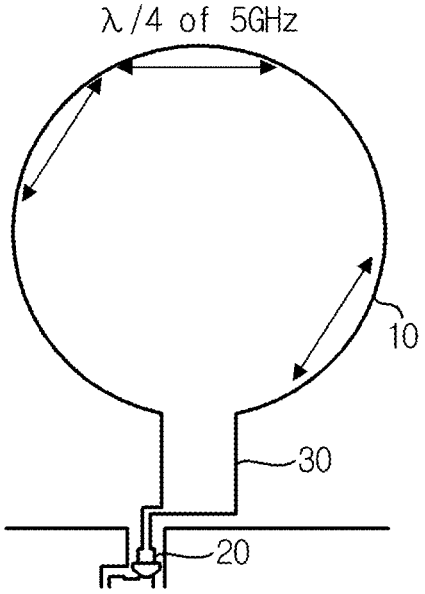

FIG. 3 is a schematic view illustrating size of an ultra wide band antenna according to an exemplary embodiment of the present invention.

Referring to FIG. 3, the ultra wide band antenna according to an exemplary embodiment of the present invention may include a radiator (10), a feeder (20) and an impedance feeder (30) as in FIGS. 1 and 2.

The radiator (10) takes a round shape according to the exemplary embodiment of the present invention, but may have an ultra wide band characteristic with a square shape. An antenna may have various bands according to shapes and sizes of a radiator.

When the radiator (10) takes a round shape as the ultra wide band antenna according to an exemplary embodiment of the present invention, and the antenna may operate as an ultra wide band antenna including a low frequency band as a diameter of a circle increases. Thus, the size, that is, the diameter of round radiator can be adjusted to cater to a frequency band to be used.

The exemplary embodiment of the present invention may be formed with a round radiator (10) having a diameter 2.5 times greater than a cross directional length (λ) of the impedance feeder (30). In this case, the impedance feeder (30) connecting the feeder (20) to the radiator (10) must be appropriately configured size-wise to support the most efficient radiation of the electric wave to a relevant radiator. Thus, a diameter of a radiator and a vertical direction length of the radiator may be obtained by the following Equations 1 and 2, where λ is a cross directional length of the impedance feeder (30).

$$\text{Diameter}=2.5\times\lambda \qquad \text{[Equation 1]}$$

$$\text{Vertical direction length}=1.15\times\lambda \qquad \text{[Equation 2]}$$

The ultra wide band antenna according to the exemplary embodiment of the present invention may constitute the radiator (10) and the impedance radiator (30) based on the above-referenced Equations 1 and 2. Furthermore, the ultra wide band antenna according to the exemplary embodiment of the present invention may be increased or decreased by increasing or decreasing λ while satisfying the above-referenced Equations 1 and 2.

However, the diameter of the radiator (10) of the ultra wide band antenna according to the exemplary embodiment of the present invention may be changed within a range of 2.0~3.0 times of λ. Furthermore, the vertical direction length of the impedance radiator (30) of the ultra wide band antenna according to the exemplary embodiment of the present invention may be changed within a range of 1.0~1.3 times of λ.

That is, the diameter of the radiator (10) and the vertical direction length of the impedance radiator (30) may be respectively selected within the ranges of 2.0~3.0 times and 1.0~1.3 times of and any antenna satisfying these ranges may perform the ultra wide band communication.

To be more specific, when the impedance radiator (30) is increased based on the cross directional length λ while maintaining the VSWR (Voltage Standing Wave Ratio) less than 2:1, a startband, that is, a value of start portion of frequency passing a signal becomes much lower, whereby a lower frequency becomes a start band.

FIG. 4 is a schematic view illustrating a wavelength useable by an ultra wide band antenna according to an exemplary embodiment of the present invention.

Referring to FIGS. 4*a* to 4*d*, lengths of various wavelengths may be used from the round radiator (10) and the impedance feeder (30) such as λ/4 wavelength of 1.8 GHz (4*a*), λ/4 wavelength of 2.4 GHz(4*b*), λ/4 wavelength of 3 GHz(4*c*) and λ/4 wavelength of 5 GHz(4*d*), and may be operated as an ultra wide band antenna.

Therefore, the ultra wide band antenna according to the exemplary embodiment of the present invention can use lengths of various wavelengths from the same round radiator (10) to be useable for an MIMO (Multiple Input Multiple Output) communication.

Figure 5:
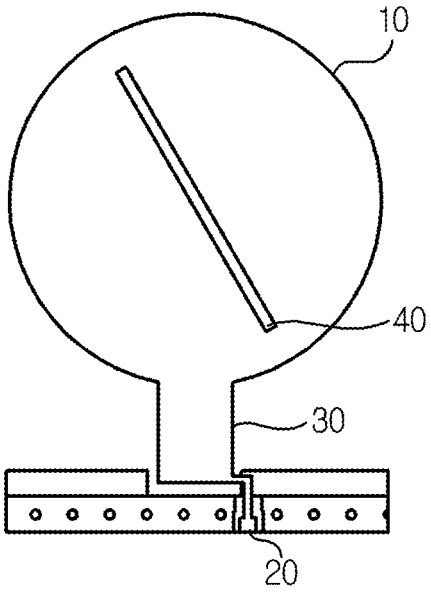
FIG. 5 is a schematic view illustrating an ultra wide band antenna formed with a slot according to an exemplary embodiment of the present invention.

FIG. 5 is a schematic view illustrating an ultra wide band antenna formed with a slot according to an exemplary embodiment of the present invention.

Referring to FIG. 5, the ultra wide band antenna formed with a slot according to an exemplary embodiment of the present invention may further include a slot portion (40) in addition to a radiator (10), a feeder (20) and an impedance feeder (30) as in FIGS. 1 to 3.

The slot unit (40) is configured to optimize phase angles at 90, 120 and 180 degrees respectively, and may be positioned in any shape in addition to a simple linear shape. That is, the slot unit (40) may exhibit various characteristics depending on factors such as length, width and direction of the slot, and may be available in various shapes depending on an antenna of desired frequency.

Figure 6:
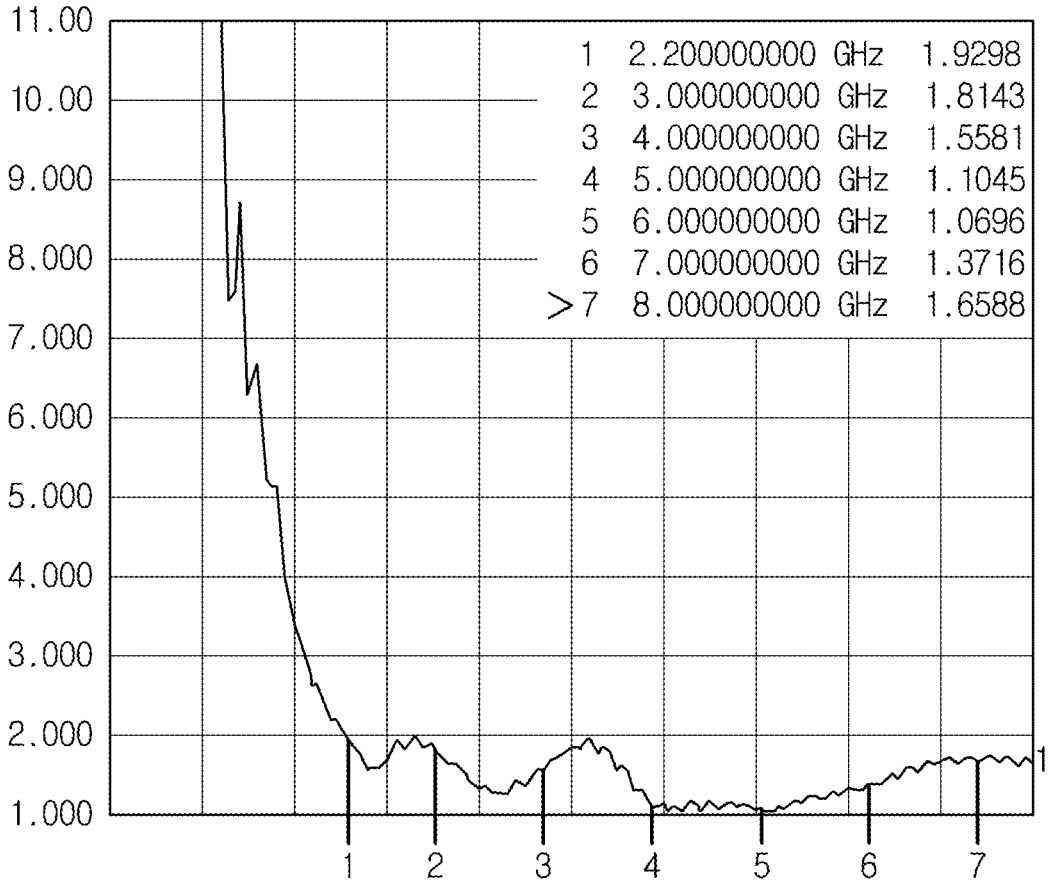
FIGS. 6 and 7 are schematic view illustrating a VSWR (Voltage Standing Wave Ratio) in response to size of a radiator (10) in an ultra wide band antenna according to an exemplary embodiment of the present invention.
Figure 7:
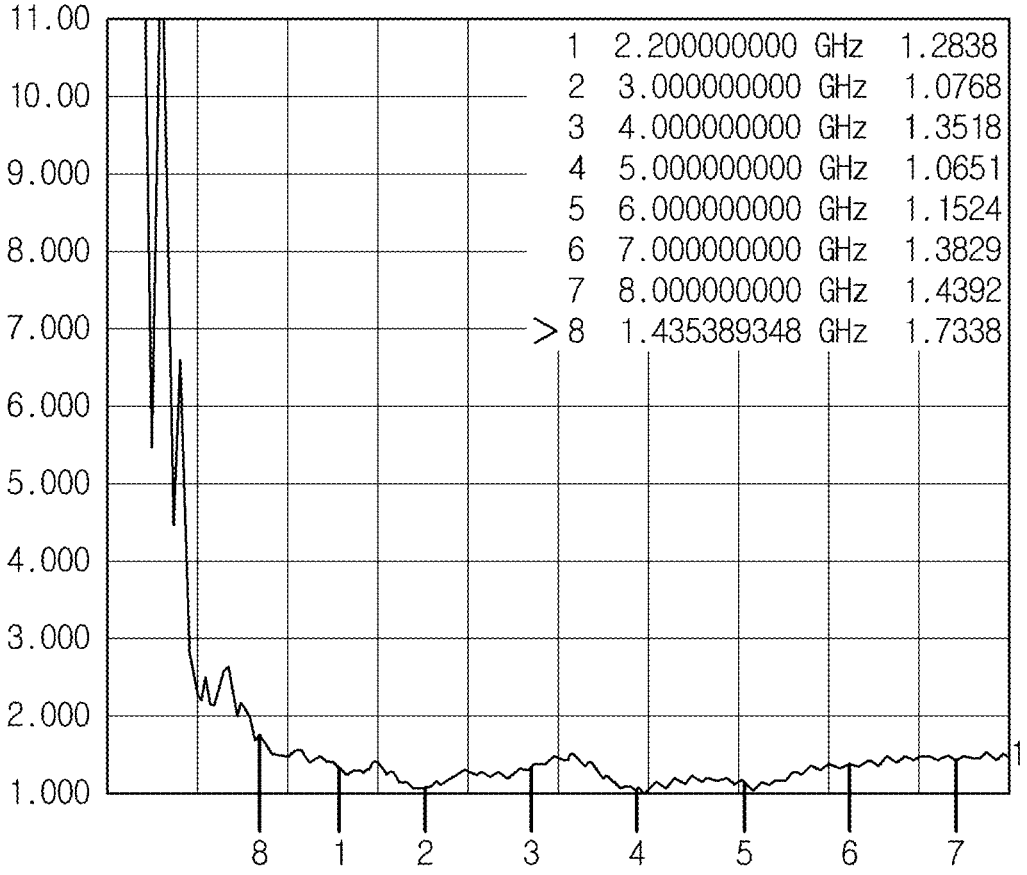

FIGS. 6 and 7 are schematic view illustrating a VSWR (Voltage Standing Wave Ratio) in response to size of a radiator (10) in an ultra wide band antenna according to an exemplary embodiment of the present invention.

FIG. 6 illustrates a VSWR relative to each frequency where λ is 2.4 millimeter, and FIG. 7 illustrates a VSWR relative to each frequency where λ is 2.5 millimeter.

Referring to FIGS. 6 and 7, it can be noted that, as λ increases, that is, as a diameter of the radiator (10) increases, a position of minimum point, where the VSWR becomes below 2:1 (vertical axis of the graph), moves to a lower value, which means that a startband which is a start frequency of passband decreases to a lower value, which also means that an antenna including a lower passband frequency is possible.

To be more specific, it can be noted that, although, when λ was 2.4 millimeter, the startband frequency was 2.2 GHz, the startband frequency was approximately 1.4354 GHz when λ, was 2.5 millimeter, whereby a passband of approximately 765 MHz can be further secured.

The ultra wide band antenna according to an exemplary embodiment of the present invention may be manufactured in the form of printed shape on a PCB (Printed Circuit Board) to thereby accomplish an effect of speedy manufacturing and reduced defect.

Although the ultra wide band antenna according to an exemplary embodiment of the present invention is preferably manufactured in a printed shape on a dielectric substrate, the ultra wide band antenna according to an exemplary embodiment of the present invention may be manufactured with a metal material. A combined couple with a metal and dielectric substance can also exhibit the characteristics of an ultra wide band antenna. Furthermore, a PIFA (Planar Inverted-F Antenna) structure with a hole may also demonstrate ultra wide band antenna characteristics.

Figure 8:
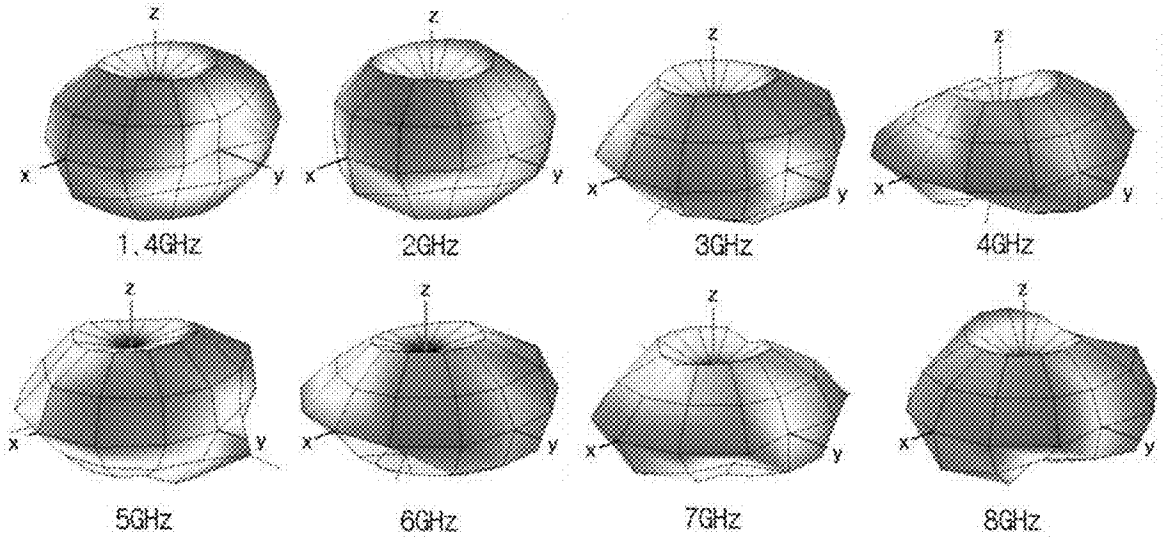
FIG. 8 is a schematic view illustrating a radiation pattern of an antenna for each frequency in an ultra wide band antenna according to an exemplary embodiment of the present invention.

FIG. 8 is a schematic view illustrating a radiation pattern of an antenna for each frequency in an ultra wide band antenna according to an exemplary embodiment of the present invention.

It can be noted from FIG. 8 that radiation of electric wave actually occurs in all frequencies in the ultra wide band antenna according to an exemplary embodiment of the present invention, from which the ultra wide band antenna according to an exemplary embodiment of the present invention is noticeable to operate with high efficiency at wide bands.

Although the ultra-wide band antenna according to an exemplary embodiment of the present invention has been described with reference to a number of limited illustrative embodiments thereof, it should be understood that numerous other modifications and embodiments can be devised by those skilled in the art that will fall within the spirit and scope of the principles of this disclosure. Therefore, it should be understood that the above-described embodiments are not limited by any of the details of the foregoing description and drawings, unless otherwise specified, but rather should be construed broadly within the scope as defined in the appended claims

The invention claimed is:

1. An ultra wide band antenna, the ultra wide band antenna comprising:

a radiator configured to emit an electromagnetic wave passing through the antenna;

a feeder configured to supply an electric signal to the radiator; and an impedance feeder connected to the radiator and to the feeder and having a rectangular shape, wherein a diameter of the radiator is 2.0-3.0 times greater than a cross-directional length (λ) of the impedance feeder, and wherein a vertical direction length of the impedance feeder is 1.0-1.3 times greater than the cross-directional length (λ) of the impedance feeder.

2. The ultra wide band antenna of claim 1, further comprising a slot portion inside the radiator configured to increase antenna efficiency.

3. The ultra wide band antenna of claim 1, further comprising a metal reflective patch coupled to an upper surface of the radiator, and equal to or smaller in size than the radiator.

4. The ultra wide band antenna of claim 1, wherein the radiator takes a round shape.

5. The ultra wide band antenna of claim 1, wherein the diameter of the radiator is 2.5 times greater than the cross-directional length (λ) of the impedance feeder, and the vertical direction length of the impedance feeder is 1.15 times greater than the cross-directional length (λ) of the impedance feeder.

* * * * *